US006851927B2

(12) United States Patent
Klaus et al.

(10) Patent No.: US 6,851,927 B2
(45) Date of Patent: Feb. 8, 2005

(54) FLUID-FLOW MACHINE WITH HIGH-PRESSURE AND LOW-PRESSURE REGIONS

(75) Inventors: Gerhard Klaus, Wesel (DE); Ingo Stephan, Görlitz (DE)

(73) Assignee: Siemens Aktiengesellschaft, Munich (DE)

( * ) Notice: Subject to any disclaimer, the term of this patent is extended or adjusted under 35 U.S.C. 154(b) by 30 days.

(21) Appl. No.: 10/359,229

(22) Filed: Feb. 6, 2003

(65) Prior Publication Data

US 2003/0175117 A1 Sep. 18, 2003

(30) Foreign Application Priority Data

Feb. 6, 2002 (EP) ..... 02002719

(51) Int. Cl.[7] ..... F01D 1/02
(52) U.S. Cl. ..... 415/199.4; 415/116; 415/93
(58) Field of Search ..... 415/99–108, 199.1–199.5, 415/203, 93, 116, 193, 184, 198, 199 R

(56) References Cited

U.S. PATENT DOCUMENTS 1,622,805 A * 3/1927 Pape ..... 415/101
2,796,231 A * 6/1957 Hertl ..... 415/108
2,823,891 A * 2/1958 Baker et al. ..... 415/93
3,973,404 A * 8/1976 Iizuka et al. ..... 60/693
4,027,996 A 6/1977 Keller et al.
4,362,464 A * 12/1982 Stock ..... 415/136
5,149,247 A * 9/1992 Gros et al. ..... 415/108
6,305,901 B1 * 10/2001 Bell et al. ..... 415/100

FOREIGN PATENT DOCUMENTS

| | | | |
|---|---|---|---|
| CH | 527 364 | A | 10/1972 |
| DE | 19 19 734 | A | 11/1970 |
| EP | 0 953 099 | B1 | 11/1999 |
| FR | 813 337 | A | 5/1937 |
| GB | 100 369 | A | 4/1917 |
| GB | 102 741 | A | 6/1917 |

* cited by examiner

*Primary Examiner*—Edward K. Look
*Assistant Examiner*—James M. McAleenan
(74) *Attorney, Agent, or Firm*—Harness, Dickey & Pierce, P.L.C.

(57) ABSTRACT

A fluid-flow machine includes an outer casing having a rotationally mounted rotor with three blade regions. The blade regions are divided into an inner blade region and two outer blade regions, the two outer blade regions pointing outward toward the outer casing end. The fluid-flow machine includes one or more outlet openings, via which the flow medium is divided into two partial flows. The two partial flows then flow through the respective outer blade regions.

34 Claims, 2 Drawing Sheets

FLUID-FLOW MACHINE WITH HIGH-PRESSURE AND LOW-PRESSURE REGIONS

The present application hereby claims priority under 35 U.S.C. §119 on European patent application number EP 02002719.9 filed Feb. 6, 2002, the entire contents of which are hereby incorporated herein by reference.

FIELD OF THE INVENTION

The invention generally relates to a fluid-flow machine which includes a casing. Preferably, the casing includes a rotationally mounted rotor with three blade regions which are fluidically connected. It also generally relates to a method of operating the fluid-flow machine as a steam turbine.

BACKGROUND OF THE INVENTION

Known fluid-flow machines which have a high-pressure and a low-pressure-steam region may be of single-cylinder or two-cylinder construction. Such fluid-flow machines, in particular steam turbines, are shown in 1997P03012 DE. The two-cylinder design does not belong to the technical field of the present invention and is therefore not described in more detail. The single-cylinder design consists of a rotor having two single-flow blade regions which point toward the respective casing ends. One blade region is designed as a high-pressure-steam blade region and another blade region is designed as a low-pressure-steam region. Inflowing live steam flows in the axial direction first of all through the blade region of the high-pressure-steam blade region. From there, the steam, which is now partly expanded, passes via a line to the intermediate-pressure-steam blade region.

In the high-pressure and intermediate-pressure regions, the specific volume, at a constant mass flow, increases relatively slightly in the course of the expansion. Starting from the transition region between intermediate pressure and low pressure (about 2 to 3 bar), the specific steam volume increases sharply, and the volumetric flow and thus the requisite flow area likewise increase sharply. Physical limits (e.g. strength) are encountered when realizing the flow area and this involves considerable construction outlay.

A disadvantage with these known embodiments having a high-pressure expansion region is that superheated steam comes in contact with the interior of a turbine end. To reduce the amount of steam escaping from the turbine, a plurality of sealing shells are arranged between outer casing and rotor. The high-energy steam between the sealing shells is partly fed back into blading regions of lower temperature for the thermodynamic optimization of the process. In this case, the introduction of the sealing shell steam into the blading regions leads to asymmetrical casing heating at the casing circumference, and this asymmetrical casing heating results in thermal stresses and deformations, i.e. distortion of the casing, which may possibly lead to grazing of blades on the casing.

SUMMARY OF THE INVENTION

An object of an embodiment of the present invention is therefore to design a single-cylinder fluid-flow machine in such a way that no feedback of sealing shell steam with regard to thermodynamic optimization of the process is necessary.

A further object of an embodiment of the invention is to specify a method of operating a steam turbine.

According to an embodiment of the invention, the object which relates to the fluid-flow machine may be achieved in that the fluid-flow machine has an outer casing in which a rotor with three blade regions is mounted in a rotational manner, one of the blade regions being an inner region and the other blade regions being outer regions, through which blade regions a flow medium flows in a respective direction of flow during operation, the inner blade region being enclosed by the outer blade regions along the rotor, and the directions of flow in the outer blade regions being opposed to one another and being directed away from the inner region.

This configuration, for the first time, takes advantage of the fact that, by the above-described arrangement of the blade regions, an outflowing flow medium with virtually identical characteristic quantities such as pressure, temperature and volumetric flow discharges at the outer casing ends. Due to the low discharge parameters of the steam at the two casing ends, the arrangement of sealing shell systems with feedback of sealing shell steam into the blade regions is not necessary. Asymmetrical heating at the casing circumference due to the introduction of sealing shell steam is ruled out.

The compact design of the fluid-flow machine leads to further advantages in production, which lead to material and time savings. The material and time saving may be attributed, inter alia, to a design of the components in a reduced form. The use of less material leads to components of smaller mass and thereby to better start-up and operating behavior; in particular the reduction in size of the last blade stages is advantageous here.

Due to the smaller mass, the moment of inertia of the rotor changes. As a result, the start-up time is reduced.

In an advantageous development, the flow medium, after flowing through the inner blade region, is divided into two partial flows via a backflow passage. One of the partial flows flows through the backflow passage.

It is advantageous to provide the backflow passage with an axial compensator for compensating for thermal expansions. Temperature-induced outer casing stresses are thereby avoided. The axial compensator, for example, may include a bellows or the like.

The impingement of the flow medium on the rotating blade regions leads to a force acting in the axial direction. This force is called axial thrust. To compensate for the axial thrust, the rotor, in an advantageous development, is designed with a shaft step provided in front of the inner blade region.

A considerable advantage in this case results from the simple cost-effective integration in the casing.

To reduce leakages between the outer casing ends and the rotor, sealing shells with labyrinth seals or the like are arranged.

The fluid-flow machine preferably has an inflow region in which the flow medium is expanded in an adjoining expansion region by a control stage. The pressure of the flow medium in the expansion region is expanded to a wheel space pressure by a control stage. This control method provides for a rapid and precise means of controlling the fluid-flow machine and leads to good operating behavior.

An advantageous development is the design of the fluid-flow machine as a steam turbine.

The fluid-flow machine may be advantageously designed as an axial-flow compressor.

The object which relates to the method may be achieved according to an embodiment of the invention by the description of a method for operating a steam turbine. The steam turbine is designed with a rotationally mounted rotor having three blade regions, one of the blade regions being an inner region and the other blade regions being outer regions, through which blade regions a flow medium flows in a respective direction of flow during operation, the inner blade region being enclosed by the outer blade regions along the rotor, and the flow medium, after flowing through the inner blade region, being divided into two partial flows. After the division into the two partial flows, the one partial flow flows through an outer blade region and the other partial flow flows through the other blade region.

BRIEF DESCRIPTION OF THE DRAWINGS

The invention is explained in more detail below with reference to exemplary embodiments which are shown schematically in the drawings.

For the same and functionally identical components, the same designations are used throughout. In the drawings.

DETAILED DESCRIPTION OF THE PREFERRED EMBODIMENTS

Figure 1:
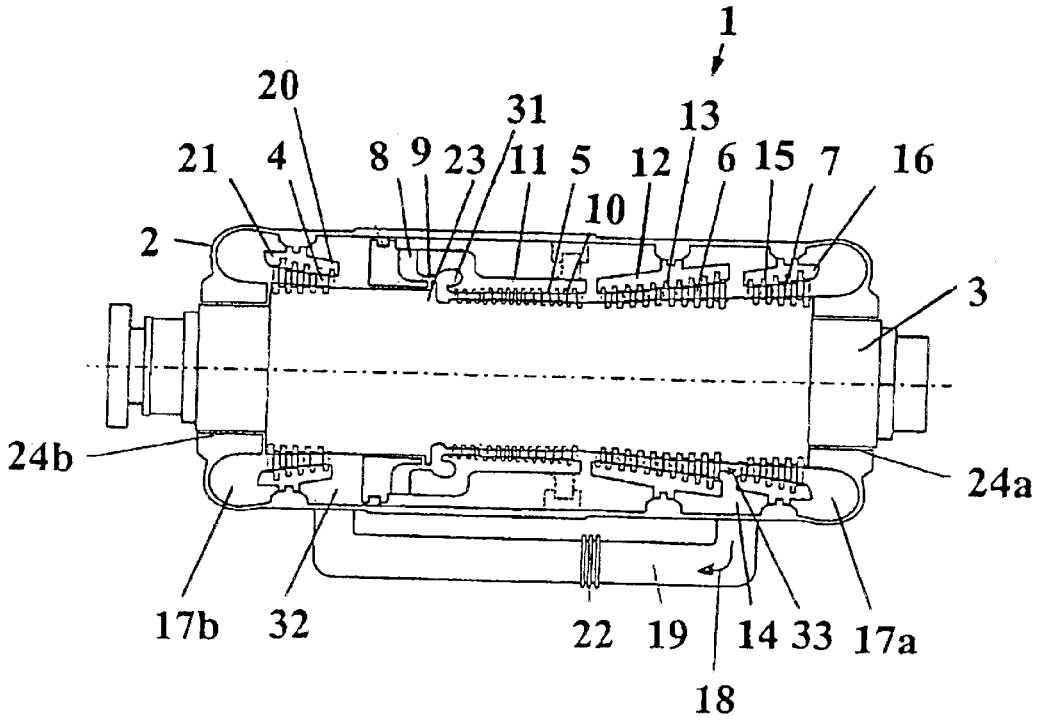
FIG. 1 shows a schematic longitudinal section through a fluid-flow machine.

FIG. 1 shows a schematic longitudinal section through a fluid-flow machine 1 having an outer casing 2, a plurality of inner casings 11, 12, 16, 21 and a rotor 3. Four blade regions 4, 5, 6, 7 are arranged on the rotor 3. In this exemplary embodiment, the four blade regions are divided into two inner blade regions 5, 6 and two outer blade regions 4, 7. The two outer blade regions 4, 7 are arranged in opposition to one another and point away from the inner blade regions 5, 6.

Upstream of the first inner blade region 5, an inflow opening 8 is contained in the outer casing. A control stage 9 is provided starting from the inflow opening 8 in the direction of the first inner blade region 5. An expansion region 31 follows the control stage 9 in the direction of the first inner blade region 5. In the exemplary embodiment presented, guide blades 10 are attached to the inner casing 11 in the first inner blade region 5.

Following the first inner blade region 5 is a further inner blade region 6. In the second inner blade region 6, further guide blades 13 are attached to a further inner casing 12. One or more outlet openings 14 are contained between the second inner blade region 6 and an outer blade region 7. At the outer blade region 7, further guide blades 15 are fixed to a further inner casing 16.

Located in the outer casing 2 between a further outer blade region 4 and the inflow region 8 is an inflow opening 32 which is fluidically connected to the outlet opening 14 via a backflow passage 19. In the region of the outer blade region 4, further guide blades 20 are located in a further inner casing 21.

The backflow passage 19 is provided with an axial compensator 22 in order to compensate for thermal stresses between the backflow passage 19 and the outer casing 2.

The rotor 3 is designed with a shaft step 23 in order to compensate for the axial thrust of the rotor 3.

Sealing shells 24*a* and 24*b* are arranged between the rotor 3 and the outer casing 2 in order to reduce the leakage from the fluid-flow machine.

During operation, a flow medium flows via the inflow opening 8 into the fluid-flow machine 1. From there, the flow medium passes to the control stage 9, where the pressure is expanded to a wheel space pressure. The flow medium then flows through the first blade region 5. In the exemplary embodiment shown, the flow medium then flows through the second blade region 6. Downstream of this second blade region 6, the flow medium is separated into two partial flows 18, 33 by way of one or more openings 14. The partial flow 33 flows through the outer blade region 7. The second partial flow 18 flows via the backflow passage 19 into an inflow opening 32. From there, the partial flow flows through the further outer blade region 4. After flowing through the outer blade regions 4, 5, both partial flows pass out of the fluid-flow machine 1 via outlet openings 17*a*, 17*b*.

Due to the separation of the flow medium into two partial flows 18, 33 and due to the arrangement shown of the blade regions 4, 5, 6 and 7, the individual partial flows of the separated flow medium reach the outer blade regions 4, 7 with virtually identical characteristic quantities such as pressure, temperature and volumetric flow. A resulting advantage is the symmetrical casing heating. Due to the low state variables of the flow medium in these regions, smaller thermal deformations occur, and the operating reliability of the fluid-flow machine increases. The design of the sealing shells between outer casing and rotor is advantageous for reducing the leakage without feedback of sealing shell steam between the blading regions.

The compact single-cylinder design results in further advantages in production and in the start-up and operating behavior. In this case, advantage is taken of the fact that material can be saved. In particular, the last blade stages can be produced in smaller sizes.

Figure 2:
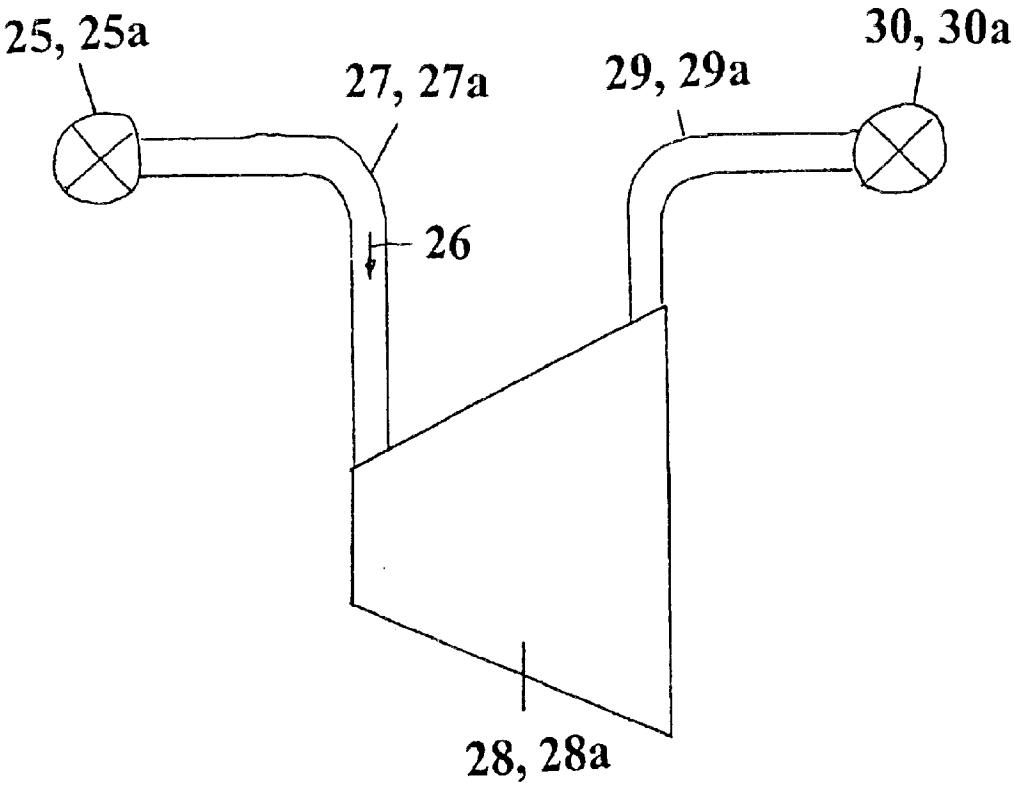
FIG. 2 shows a representation of the basic mode of operation of a turbine and an axial-flow compressor.

The operating principle of the fluid-flow machine 1 according to an embodiment of the invention is shown in FIG. 2. The fluid-flow machine may be designed as a steam turbine on the one hand and as an axial-flow compressor on the other hand.

In a design as a steam turbine, the operating principle is as described below. Via a steam generator 25, superheated steam 26 passes via a feed line 27 into a steam turbine interior 28. After flowing through the above-described blade regions 4, 5, 6 and 7 in the steam turbine interior 28, the superheated steam is expanded and flows via a discharge line 29 to a condenser 30. The rotation of the rotor 3 may be used for generating electrical energy.

In a design as an axial-flow compressor, the operating principle is as described below. By forced rotation of the rotor 3, atmospheric air or the like in an inlet opening 30*a* is fed via a feed line 29*a* into an axial-flow-compressor interior 28*a*. In the axial-flow-compressor interior 28*a*, by a direction of rotation of the rotor 3 and thus of the above-described blade regions 4, 5, 6 and 7 which is reversed compared with the steam turbine, the atmospheric air is compressed and passes via a line 27*a* in a highly compressed manner to an outlet 25*a*.

LIST OF REFERENCES

1 Fluid-flow machine
2 Outer casing
3 Rotor
4 Outer blade region
5 Inner blade region
6 Inner blade region
7 Outer blade region
8 Inflow opening
9 Control stage
10 Guide blades

11 Inner casing
12 Inner casing
13 Guide blades
14 Outlet openings
15 Guide blades
16 Inner casing
17*a, b* Outlet openings
18 Second partial flow
19 Backflow passage
20 Guide blades
21 Inner casing
22 Axial compressor
23 Shaft step
24*a, b* Sealing shells
25 Steam generator
26 Superheated steam
27 Feed line
28 Steam turbine interior
29 Discharge line
30 Condenser
31 Expansion region
32 Inflow opening
33 First partial flow The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A fluid-flow machine, comprising:

a single outer casing; and a rotor with at least three blade regions, mounted in the casing in a rotational manner, wherein one of the blade regions is an inner region and at least two other blade regions are outer regions, wherein a flow medium is adapted to flow through the blade regions in a respective direction of flow during operation, wherein the inner blade region is enclosed by the outer blade regions along the rotor, and wherein the directions of flow in the outer blade regions are opposed to one another and are directed away from the inner region.

2. The fluid-flow machine as claimed in claim 1, wherein the flow medium, after flowing through the inner blade region, is adapted to be divided by a backflow passage such that one part of the flow medium flows through one outer blade region and a second part flows through another outer blade region.

3. The fluid-flow machine as claimed in claim 2, wherein the backflow passage is provided with an axial compensator for compensating for a thermal expansion.

4. The fluid-flow machine as claimed in claim 1, wherein, to compensate for axial thrust, the rotor is designed with a shaft step provided in front of the inner blade region.

5. The fluid-flow machine as claimed in claim 1, further comprising, sealing shells arranged between the rotor and outer casing, to reduce leakages from the fluid-flow machine.

6. The fluid-flow machine as claimed in claim 1, further comprising:

at least one inflow region for the flow medium; and an expansion region adjoining the inflow region, wherein the pressure of the flow medium in the expansion region is adapted to be expanded to a wheel space pressure by a control stage.

7. The fluid-flow machine as claimed in claim 1, wherein the fluid flow machine is at least part of a steam turbine.

8. The fluid-flow machine as claimed in claim 1, wherein the fluid flow machine is at least part of an axial-flow compressor.

9. A method of operating a steam turbine, designed with a single casing and a rotationally mounted rotor including at least three blade regions, one of the blade regions being an inner region and at least two other blade regions being outer regions, which a flow medium is adapted to flow in a respective direction of flow through the blade regions, during operation, the inner blade region being enclosed by the outer blade regions along the rotor, comprising the steps of:

dividing the flow medium, after flowing through the inner blade region, into two partial flows, the one partial flow flowing through an outer blade region and the other partial flow flowing through the other blade region.

10. The fluid-flow machine as claimed in claim 2, wherein, to compensate for axial thrust, the rotor is designed with a shaft step provided in front of the inner blade region.

11. The fluid-flow machine as claimed in claim 3, wherein, to compensate for axial thrust, the rotor is designed with a shaft step provided in front of the inner blade region.

12. The fluid-flow machine as claimed in claim 2, further comprising, sealing shells arranged between the rotor and outer casing, to reduce leakages from the fluid-flow machine.

13. The fluid-flow machine as claimed in claim 3, further comprising, sealing shells arranged between the rotor and outer casing, to reduce leakages from the fluid-flow machine.

14. The fluid-flow machine as claimed in claim 4, further comprising, sealing shells arranged between the rotor and outer casing, to reduce leakages from the fluid-flow machine.

15. A steam turbine, comprising a fluid-flow machine as claimed in claim 1.

16. An axial-flow compressor, comprising a fluid-flow machine as claimed in claim 1.

17. A steam turbine, comprising a fluid-flow machine as claimed in claim 2.

18. An axial-flow compressor, comprising a fluid-flow machine as claimed in claim 2.

19. A steam turbine, comprising a fluid-flow machine as claimed in claim 6.

20. An axial-flow compressor, comprising a fluid-flow machine as claimed in claim 6.

21. The fluid-flow machine as claimed in claim 1, wherein the rotor includes only three blade regions.

22. The method as claimed in claim 9, wherein the rotor includes only three blade regions.

23. The fluid-flow machine as claimed in claim 1, wherein the rotor includes four blade regions, including a pair of inner and a pair of outer blade regions.

24. The method as claimed in claim 9, wherein the rotor includes four blade regions, including a pair of inner and a pair of outer blade regions.

25. A fluid-flow machine, comprising:

a single casing; and a rotor including at least three blade regions, rotationally mounted in the casing, wherein the blade regions include an inner blade region and at least two outer blade regions, the outer blade regions directed outward toward the outer ends of the casing, wherein the casing includes at least one outlet opening, adapted to divide a flow medium into two partial flows, the two partial flows being adapted to flow through respective outer blade regions.

26. The fluid-flow machine as claimed in claim 25, wherein the flow medium, after flowing through the inner blade region, is adapted to be divided by the at least one outlet opening in such a way that one part of the flow medium flows through one outer blade region and a second part flows through another outer blade region.

27. The fluid-flow machine as claimed in claim 26, wherein the at least one outlet opening is provided with an axial compensator for compensating for a thermal expansion.

28. The fluid-flow machine as claimed in claim 25, wherein, to compensate for axial thrust, the rotor is designed with a shaft step provided in front of the inner blade region.

29. The fluid-flow machine as claimed in claim 25, further comprising, sealing shells arranged between the rotor and outer casing, to reduce leakages from the fluid-flow machine.

30. The fluid-flow machine as claimed in claim 25, further comprising:

at least one inflow region for the flow medium; and an expansion region adjoining the inflow region, wherein the pressure of the flow medium in the expansion region is adapted to be expanded to a wheel space pressure by a control stage.

31. The fluid-flow machine as claimed in claim 25, wherein the rotor includes four blade regions, including a pair of inner and a pair of outer blade regions.

32. An axial-flow compressor, comprising a fluid-flow machine as claimed in claim 25.

33. A steam turbine, comprising a fluid-flow machine as claimed in claim 25.

34. The fluid-flow machine as claimed in claim 25, wherein the rotor includes only three blade regions.

* * * * *